US007275662B1

(12) United States Patent
Milcetich

(10) Patent No.: US 7,275,662 B1
(45) Date of Patent: Oct. 2, 2007

(54) BOTTLE SUPPORT DEVICE

(76) Inventor: Steve Milcetich, 15445 Cobalt St. #91, Sylmar, CA (US) 91342

( * ) Notice: Subject to any disclaimer, the term of this patent is extended or adjusted under 35 U.S.C. 154(b) by 0 days.

(21) Appl. No.: 10/622,946

(22) Filed: Jul. 18, 2003

(51) Int. Cl.
*B65D 3/00* (2006.01)
*A47B 73/00* (2006.01)
*A47D 15/00* (2006.01)

(52) U.S. Cl. ..... 222/185.1; 211/74; 248/105

(58) Field of Classification Search ..... 222/173, 222/185.1, 186; 211/74, 59.2; 248/105
See application file for complete search history.

(56) References Cited

U.S. PATENT DOCUMENTS 1,886,619 A * 11/1932 Arnone ..... 248/105
D198,488 S * 6/1964 Reis ..... D24/199
3,814,293 A * 6/1974 Daves ..... 222/173
4,143,795 A 3/1979 Casebier
4,722,463 A * 2/1988 Anderson ..... 222/185.1
5,323,917 A * 6/1994 Johnson et al. ..... 211/74
5,370,245 A 12/1994 Tersch et al.
5,377,878 A * 1/1995 Rainey et al. ..... 222/146.6
5,853,154 A * 12/1998 Ashley ..... 248/148
D425,375 S * 5/2000 Parham ..... D7/619.1
6,076,707 A 6/2000 Feldner
6,145,702 A 11/2000 Lin et al.

* cited by examiner

*Primary Examiner*—Kevin Shaver
*Assistant Examiner*—Melvin A. Cartagena

(57) ABSTRACT

A bottle support device for supporting a water bottle at angle to facilitate dispensing water in the water bottle. The bottle support device includes a body member comprising a first end and a second end. The body member tapers from the second end to the first end. The body member is designed for being positioned on a shelf of the refrigerator. The body member is designed for being positioned under the water bottle whereby the body member supports the water bottle at an angle to concentrate the water around a water nozzle of the water bottle to allow the pressure from the water to increase the rate at which water is dispensed from the water nozzle.

18 Claims, 3 Drawing Sheets

BOTTLE SUPPORT DEVICE

BACKGROUND OF THE INVENTION

1. Field of the Invention

The present invention relates to water bottle storage stands and more particularly pertains to a new bottle support device for supporting a water bottle at angle to facilitate dispensing water in the water bottle.

2. Description of the Prior Art

The use of water bottle storage stands is known in the prior art. U.S. Pat. No. 5,370,245 describes a system for supporting water cooler bottles on their side for convenience of storage and removal when ready for use. Another type of water bottle storage stand is U.S. Pat. No. 4,146,795 having a plurality of containers with an angled bottom wall that are positioned into a frame to hold the containers for dispensing liquid from the containers. U.S. Pat. No. 6,145,702 has an height adjusting means that adjusts the height of the liquid supply bottle to allow for the adjusting of a minimum liquid level in the liquid supply bottle. U.S. Pat. No. 6,076,707 has a dispensing rack engaging a beverage bottle so that the beverage bottle is positioned above the support surface.

While these devices fulfill their respective, particular objectives and requirements, the need remains for a device that has certain improved features to tilt a standard water bottle to facilitate dispensing water in the water bottle.

SUMMARY OF THE INVENTION

The present invention meets the needs presented above by providing a body member that tapers from a second end to a first end to allow the water bottle to sit an angle when the water bottle is positioned on the body member.

Still yet another object of the present invention is to provide a new bottle support device that has a periphery wall to define a recessed space to receive the water bottle and inhibit the water bottle from sliding off of the body member.

Even still another object of the present invention is to provide a new bottle support device that provides an arcuate cut out in the periphery wall to allow the water nozzle to extend beyond the periphery wall without abutting the periphery wall.

To this end, the present invention generally comprises a body member comprising a first end and a second end. The body member tapers from the second end to the first end. The body member is designed for being positioned on a shelf of the refrigerator. The body member is designed for being positioned under the water bottle whereby the body member supports the water bottle at an angle to concentrate the water around a water nozzle of the water bottle to allow the pressure from the water to increase the rate at which water is dispensed from the water nozzle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
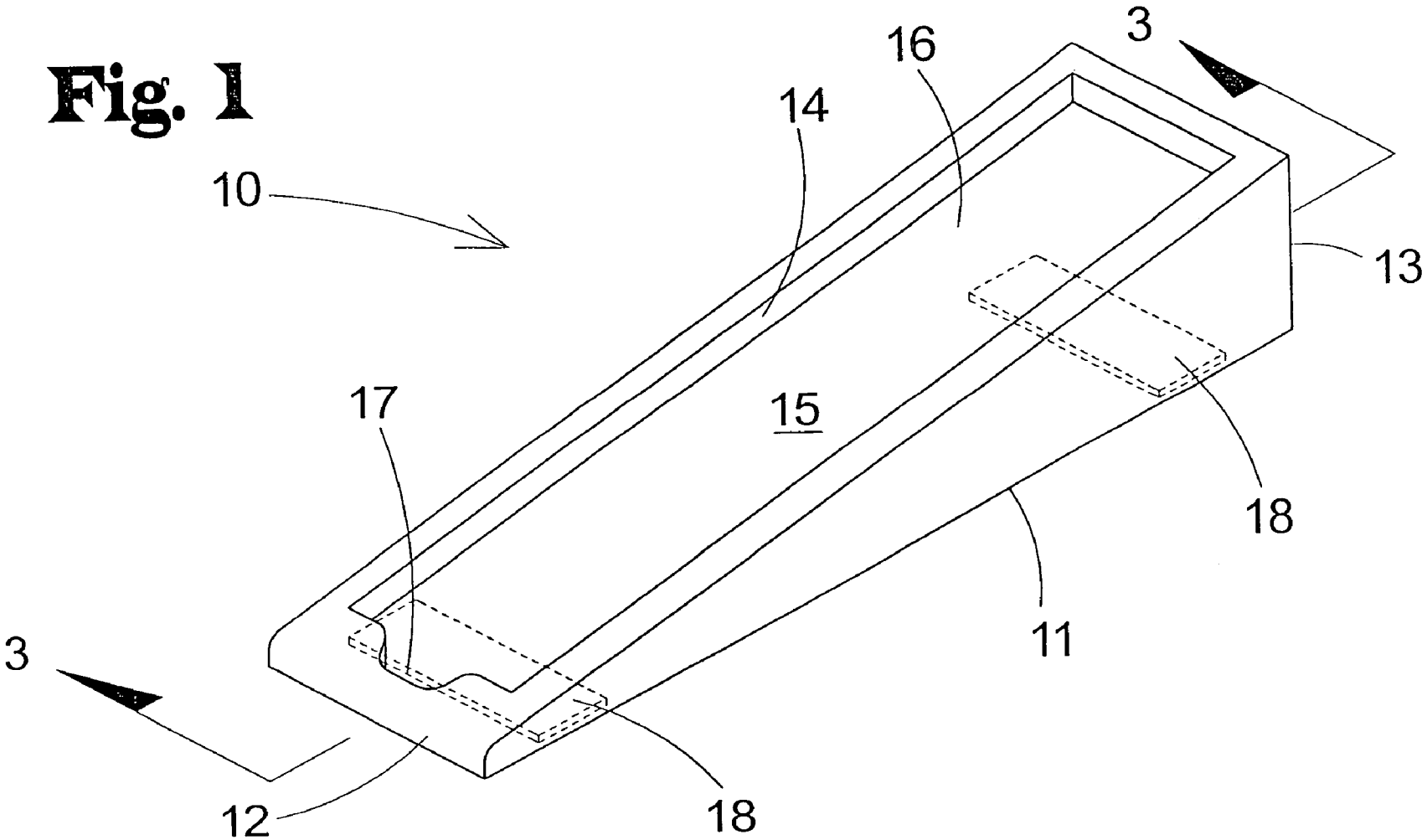
FIG. 1 is a perspective view of a new bottle support device according to the present invention.
Figure 2:
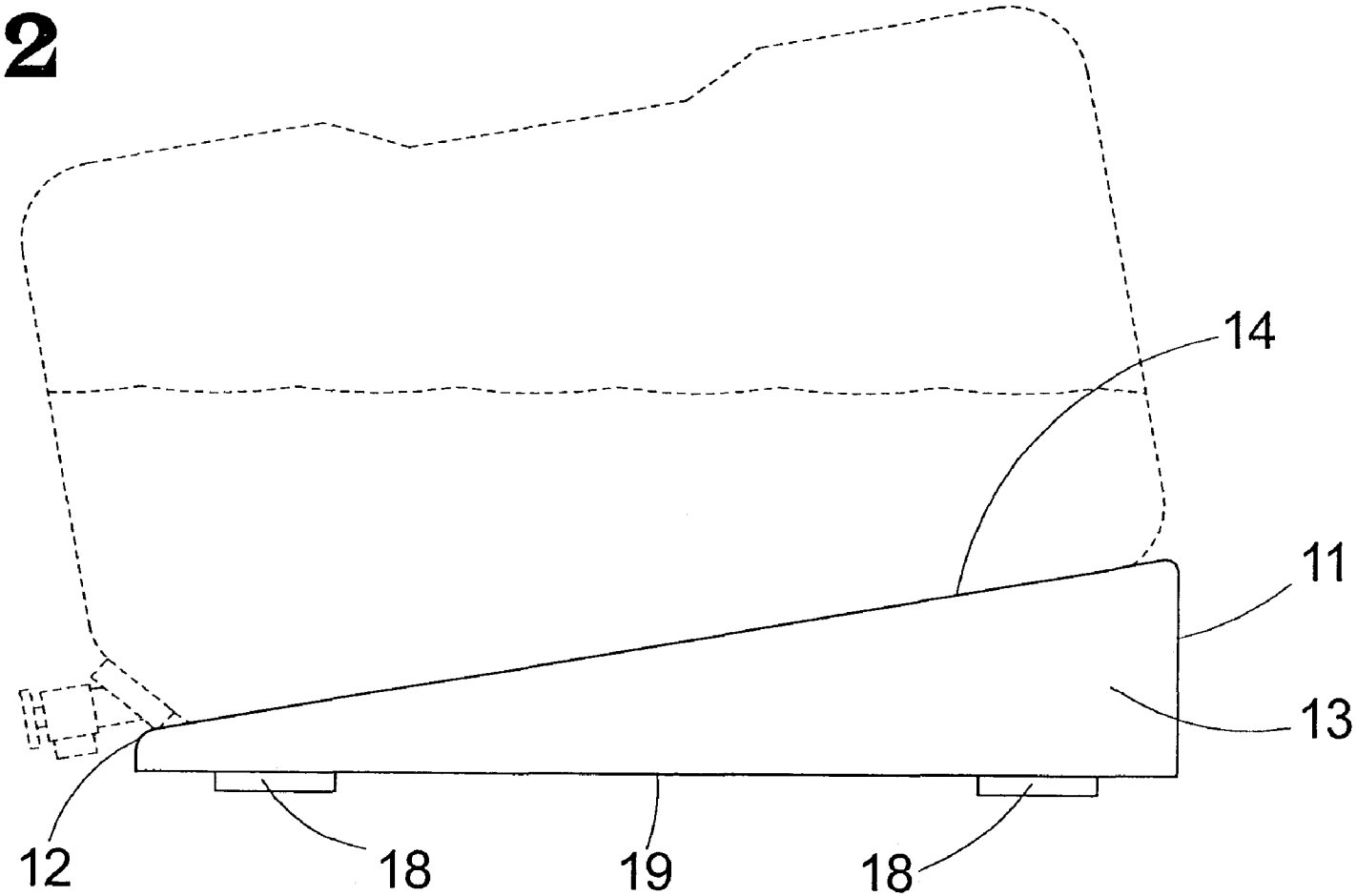
FIG. 2 is a side view of the present invention shown in use.
Figure 3:
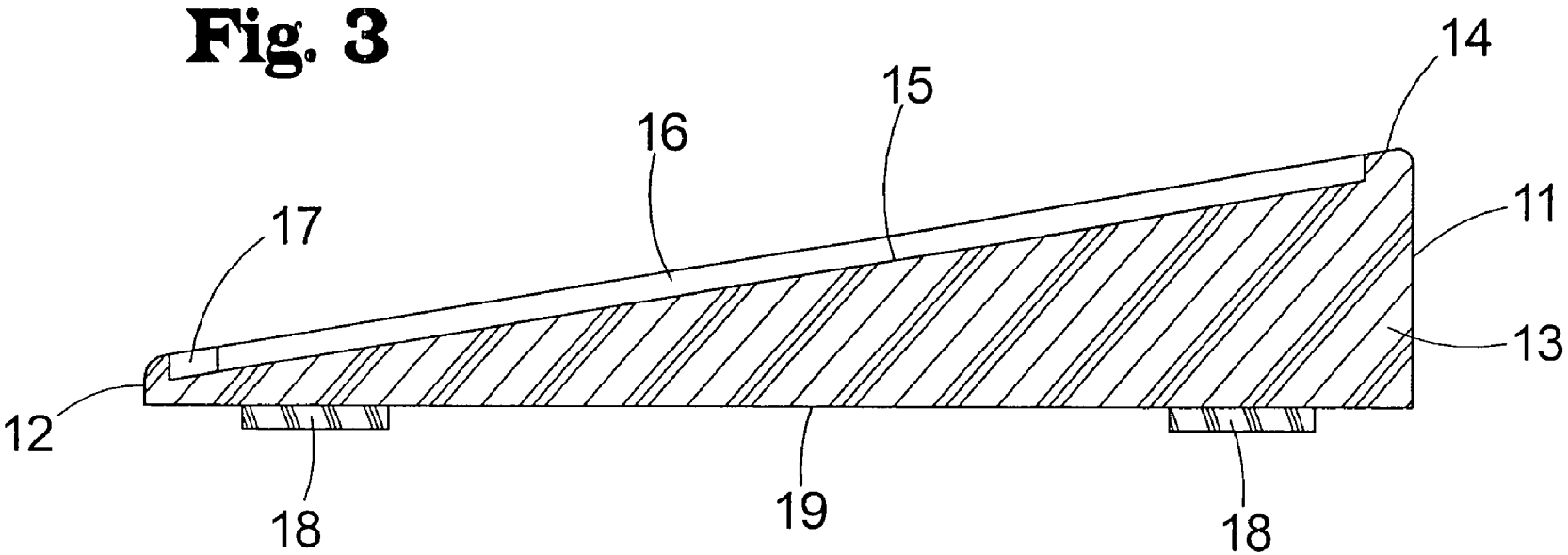
FIG. 3 is a cross-sectional view of the present invention taken along line 3-3 of FIG. 1.

With reference now to the drawings, and in particular to FIGS. 1 through 3 thereof, a new bottle support device embodying the principles and concepts of the present invention and generally designated by the reference numeral 10 will be described.

As best illustrated in FIGS. 1 through 3, the bottle support device 10 generally comprises a body member 11 comprising a first end 12 and a second end 13. The body member 11 tapers from the second end 13 to the first end 12. The body member 11 is designed for being positioned on a shelf of the refrigerator. The body member 11 is designed for being positioned under the water bottle whereby the body member 11 supports the water bottle at an angle to concentrate the water around a water nozzle of the water bottle to allow the pressure from the water to increase the rate at which water is dispensed from the water nozzle. The body member 11 comprises a plastic material whereby the plastic material is light weight to be easily moved by the user and yet rigid enough to support the weight of the water and the water bottle. The body member 11 has a width of about 6¼ inches and a length of about 10½ inches.

A periphery wall 14 is coupled to the body member 11 whereby the periphery wall 14 extends upwardly from a top surface 15 of the body member 11. The periphery wall 14 and the body member 11 define a recessed space 16 whereby the recessed space 16 designed for receiving the water bottle. The periphery wall 14 is designed for selectively abutting the water bottle whereby the periphery wall 14 is for inhibiting sliding of the water bottle off of the body member 11 when the water bottle is position on the body member 11. The periphery wall 14 has a height of about ¾ of an inch thereby providing the recessed space 16 with a depth of about ¾ of an inch. The height of the body member 11 to and the periphery wall 14 at the first end 12 of the body member 11 is about an inch. The height of the body member 11 and the periphery wall 14 at the second end 13 of the body member 11 is about 4½ inches to allow for the body member 11 to taper from the second end 13 to the first end 12.

The periphery wall 14 comprises an arcuate cut out 17 extending into the periphery wall 14. The arcuate cut out 17 is positioned proximate the first end 12 of the body member 11. The arcuate cut out 17 is designed for providing clearance of the periphery wall 14 by the water nozzle of the water bottle when the water bottle is positioned in the recessed space 16 defined by the periphery wall 14 and the body member 11.

At least one foot member 18 is coupled to a bottom surface 19 of the body member 11. The foot member 18 is designed for being positioned between the body member 11 and the shelf of the refrigerator whereby the foot member 18 is for inhibiting sliding of the body member 11 along the shelf of the refrigerator. More than one foot member 18 may be used with one being positioned proximate the first end 12 of the body member 11 and the other foot member 18 being positioned proximate the second end 13 of the body member 11. When more than one foot member 18 is used each foot member 18 has a length of about 6¼ inches and a width of about 3 inches. The foot member 18 comprises a friction enhancing material. The friction enhancing member is designed for enhancing frictional contact with the shelf of the refrigerator to inhibit sliding the body member 11 with respect to the shelf of the refrigerator. The friction enhancing material comprises a rubber material. The rubber material is designed for frictionally engaging the shelf of the refrigerator to inhibit sliding of the body member 11 with respect to the shelf of the refrigerator.

In use, the user places the body member 11 onto the shelf of the refrigerator so that the foot member 18 is positioned on the shelf. The water bottle is then placed on body member 11 so that the water bottle is positioned in the recessed space 16 and the water nozzle extends through the arcuate cut out 17 so that the water nozzle is not abutting against the periphery wall 14. The user then actuates the water nozzle to dispense water from the water bottle and the slope of the body member 11 concentrates the water around the water nozzle to enhance flow of water from the water nozzle.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bottle support device for supporting a water bottle in a refrigerator, the bottle support device comprising:

a body member comprising a first end and a second end, said body member having a top surface, said body member tapering from said second end to said first end, said body member being adapted for being positioned on a shelf of the refrigerator, said body member being adapted for being positioned under the water bottle such that said body member supports the water bottle at an angle to concentrate the water around a water nozzle of the water bottle to allow the pressure from the water to increase the rate at which water is dispensed from the water nozzle;

a periphery wall being coupled to said body member such that said periphery wall extends upwardly from the top surface of said body member, said periphery wall and said body member defining a recessed space such that said recessed space adapted for receiving the water bottle, said periphery wall having an inner surface extending upwardly from the top surface of said body member, said periphery wall being adapted for selectively abutting the water bottle such that said periphery wall is for inhibiting sliding of the water bottle off of said body member when the water bottle is position on said body member, said periphery wall extending along a perimeter edge of said top surface of said body member, said periphery wall having an upper edge, an entirety of the upper edge of said periphery wall lying in a single plane, said periphery wall having a uniform height extending above said top surface of said body member such that a depth of said recessed space is uniform along a length of said recessed space to allow said periphery wall to extend around a portion of the water bottle when the water bottle is positioned in said recessed spaced;

said periphery wall comprising a cavity extending into said periphery wall, said cavity being positioned proximate said first end of said body member, said cavity being adapted for providing clearance of said periphery wall by the water nozzle of the water bottle when the water bottle is positioned in the recessed space defined by said periphery wall and said body member, said cavity extending into the inner surface of said periphery wall without decreasing the uniform height of said periphery wall, said cavity being arcuate in shape;

at least one foot member being coupled to a bottom surface of said body member, said foot member being adapted for being positioned between said body member and the shelf of the refrigerator such that said foot member is for inhibiting sliding of said body member along the shelf of the refrigerator; and said foot member comprising a friction enhancing material, said friction enhancing member being adapted for enhancing frictional contact with the shelf of the refrigerator to inhibit sliding said body member with respect to the shelf of the refrigerator.

2. The bottle support device as set forth in claim 1, further comprising:

said friction enhancing material comprising a rubber material, said rubber material being adapted for frictionally engaging the shelf of the refrigerator to inhibit sliding of said body member with respect to the shelf of the refrigerator.

3. A bottle support device for supporting a water bottle in a refrigerator, the bottle support device comprising:

a body member for positioning under a water bottle to support the water bottle at an angle to concentrate the water around a water nozzle of the water bottle, said body member comprising a first end and a second end, said body member having a top surface, said body member having a thickness that tapers smaller from said second end to said first end such that said top surface is inclined downwardly toward said first end;

a periphery wall coupled to said body member and extending upwardly from the top surface of said body member to define a recessed space for receiving a portion of the water bottle, said periphery wall having an inner surface extending upwardly from the top surface of said body member, said periphery wall extending along a perimeter edge of said top surface of said body member for abutting the portion of the water bottle positioned in the recessed space such that said periphery wall inhibits sliding of the water bottle off of said body member when the water bottle is positioned on said body member;

wherein said periphery wall has an upper edge, an entirety of the upper edge of said periphery wall lying in a single plane;

wherein said periphery wall has a uniform height extending above said top surface of said body member such that a depth of said recessed space is uniform along a length of said recessed space to allow said periphery wall to extend around a portion of the water bottle when the water bottle is positioned in said recessed spaced; and wherein the recessed space includes a cavity for providing clearance for the water nozzle of the water bottle when the water bottle is positioned in the recessed space, said cavity extending into said periphery wall, said cavity being positioned proximate to said first end of said body member.

4. The bottle support of claim 3 wherein said cavity extends into the inner surface of said periphery wall without decreasing the uniform height of said periphery wall.

5. The bottle support of claim 3 wherein said cavity is arcuate in shape.

6. The bottle support of claim 3 further comprising at least one foot member for positioning between said body member and the shelf of the refrigerator to inhibit sliding of said body member along the shelf of the refrigerator, said at least one foot being coupled to a bottom surface of said body member.

7. The bottle support of claim 6 wherein said at least one foot member comprises a pair of foot members on said bottom surface of said body member.

8. The bottle support of claim 6 wherein said foot member comprises a friction enhancing material for enhancing frictional contact with the shelf of the refrigerator.

9. The bottle support of claim 8 wherein said friction enhancing material comprises a rubber material.

10. The bottle support of claim 3 wherein said cavity extends into the inner surface of said periphery wall without decreasing the uniform height of said periphery wall;

wherein said cavity is arcuate in shape;

at least one foot member for positioning between said body member and the shelf of the refrigerator to inhibit sliding of said body member along the shelf of the refrigerator, said at least one foot being coupled to a bottom surface of said body member, said at least one foot member comprising a pair of foot members on said bottom surface of said body member;

wherein said foot member comprises a friction enhancing material for enhancing frictional contact with the shelf of the refrigerator; and wherein said friction enhancing material comprises a rubber material.

11. In combination:

a water bottle having a water nozzle; and a bottle support device supporting said water bottle, said bottle support device comprising:

a body member positioned under said water bottle to support said water bottle at an angle to concentrate the water around the water nozzle of said water bottle, said body member comprising a first end and a second end, said body member having a top surface, said body member having a thickness that tapers smaller from said second end to said first end such that said top surface is inclined downwardly toward said first end;

a periphery wall coupled to said body member and extending upwardly from the top surface of said body member to define a recessed space receiving a portion of the water bottle, said periphery wall having an inner surface extending upwardly from the top surface of said body member, said periphery wall extending along a perimeter edge of said top surface of said body member to abut the portion of the water bottle positioned in the recessed space such that said periphery wall inhibits sliding of the water bottle off of said body member when the water bottle is positioned on said body member;

wherein said periphery wall has an upper edge, an entirety of the upper edge of said periphery wall lying in a single plane;

wherein said periphery wall has a uniform height extending above said top surface of said body member such that a depth of said recessed space is uniform along a length of said recessed space to allow said periphery wall to extend around a portion of said water bottle; and wherein the recessed space includes a cavity providing clearance for the water nozzle of said water bottle, said cavity extending into said periphery wall, said cavity being positioned proximate to said first end of said body member.

12. The combination of claim 11 wherein said cavity extends into the inner surface of said periphery wall without decreasing the uniform height of said periphery wall.

13. The combination of claim 11 wherein said cavity is arcuate in shape.

14. The combination of claim 11 further comprising at least one foot member for positioning between said body member and the shelf of the refrigerator to inhibit sliding of said body member along the shelf of the refrigerator, said at least one foot being coupled to a bottom surface of said body member.

15. The combination of claim 14 wherein said at least one foot member comprises a pair of foot members on said bottom surface of said body member.

16. The combination of claim 14 wherein said foot member comprises a friction enhancing material for enhancing frictional contact with the shelf of the refrigerator.

17. The combination of claim 16 wherein said friction enhancing material comprises a rubber material.

18. The combination of claim 11 wherein said cavity extends into the inner surface of said periphery wall without decreasing the uniform height of said periphery wall;

wherein said cavity is arcuate in shape;

at least one foot member for positioning between said body member and the shelf of the refrigerator to inhibit sliding of said body member along the shelf of the refrigerator, said at least one foot being coupled to a bottom surface of said body member, said at least one foot member comprising a pair of foot members on said bottom surface of said body member;

wherein said foot member comprises a friction enhancing material for enhancing frictional contact with the shelf of the refrigerator; and wherein said friction enhancing material comprises a rubber material.

* * * * *